United States Patent [19]

Widmyer

[11] 4,088,188

[45] May 9, 1978

[54] HIGH VERTICAL CONFORMANCE STEAM INJECTION PETROLEUM RECOVERY METHOD

[75] Inventor: Richard H. Widmyer, Houston, Tex.

[73] Assignee: Texaco Inc., New York, N.Y.

[21] Appl. No.: 644,365

[22] Filed: Dec. 24, 1975

[51] Int. Cl.[2] ..... E21B 43/24

[52] U.S. Cl. ..... 166/269; 166/303

[58] Field of Search ..... 166/258, 266, 267, 272, 166/269, 303, 306

[56] References Cited

U.S. PATENT DOCUMENTS

| | | | |
|---|---|---|---|
| 2,994,375 | 8/1961 | Hurley | 166/258 |
| 3,221,810 | 12/1965 | Marx | 166/269 |
| 3,289,758 | 12/1966 | Martin et al. | 166/269 |
| 3,323,590 | 6/1967 | Gilchrist et al. | 166/258 |
| 3,410,344 | 11/1968 | Cornelius | 166/306 |
| 3,412,794 | 11/1968 | Craighead | 166/303 |
| 3,421,583 | 1/1969 | Koons | 166/303 |
| 3,455,384 | 7/1969 | Gilchrist et al. | 166/272 |
| 3,565,175 | 2/1971 | Wilson | 166/269 |

FOREIGN PATENT DOCUMENTS

| | | | |
|---|---|---|---|
| 648,280 | 9/1962 | Canada | 166/258 |
| 711,556 | 6/1965 | Canada | 166/272 |

*Primary Examiner*—Ernest R. Purser

*Attorney, Agent, or Firm*—Carl G. Ries; Thomas H. Whaley; Jack H. Park

[57] ABSTRACT

Viscous oil recovery methods employing well-to-well throughput steam injection are frequently less successful than anticipated because the process experiences poor vertical conformance, meaning that only a portion of the full vertical thickness of the oil saturated reservoir is contacted by the injected steam. Because the specific gravity of the vapor phase portion of saturated steam is substantially less than the specific gravity of formation petroleum fluids, the vapor phase steam channels across the upper portion of the formation and only contacts and displaces petroleum present in said upper portion of the formation, bypassing substantial amounts of petroleum in the lower portion of the formation. By separating saturated steam into two components, one predominantly liquid phase and one predominantly gaseous phase, and injecting the hot liquid into the upper portion of the formation and the vapor into the lower portion of the formation, substantially greater amounts of formation petroleum are contacted and recovered by steam. Steam may be separated into liquid and vapor phase components on the surface and injected by a separate flow path into separately completed intervals, or the separation may be accomplished in a downhole separator. The process may be applied using steam alone, or other gaseous and/or liquid phase additives to steam may be injected in the same manner.

12 Claims, 3 Drawing Figures

HIGH VERTICAL CONFORMANCE STEAM INJECTION PETROLEUM RECOVERY METHOD

BACKGROUND OF THE INVENTION

1. Field of the Invention

The present invention concerns a method for recovering petroleum, especially viscous or heavy petroleum from subterranean formations by injecting hot fluids into the formation including low quality steam which is a mixture of liquid and gaseous phase components. More specifically, this invention concerns a method for injecting steam or mixture of steam and other additives into the formation in such a manner that the tendency for steam vapors to channel through the upper portion of the formation, bypassing substantial portions of the petroleum in the lower portion of the formation, is minimized.

2. Description of the Prior Art

Steam injection or steam flooding has gained substantial recognition in the art as a preferred method for recovering viscous or heavy oil from subterranean formations. For the purpose of the present application, it is meant by use of the term "heavy oil", petroleum which has an API gravity less than about 12° API. Steam injection is generally applied to subterranean formations which have a low potential for production, e.g. less than about 10 percent of their initial petroleum by primary means, involving penetrating the formation with a well and pumping the petroleum contained therein to the surface of the earth without applying any treatment to formation petroleum to reduce its viscosity.

Steam may be used for oil recovery purposes in at least two general methods. In the first, steam is injected into one or more wells for a period of time, after which steam injection is terminated and petroleum is allowed to flow to the surface of the earth through the same well or wells as were used for injecting the steam in the formation. This cyclical procedure, sometimes referred to as "push-pull" steam stimulation, is an efficient method for simulating production from a well, but it is not satisfactory for exploiting a large aerial extent of a formation because the effect of steam injection diminishes in a push-pull sequence with distance from the point of injection due to heat losses and an ever increasing volume of depleted formation which must be saturated with steam before any new portion of the formation is contacted.

The second basic approach to steam injection is a well-to-well throughput process in which at least two wells are drilled into the formation and steam is injected into one well to pass through the permeable formation, displacing petroleum toward a remotely located well. This process has the advantage of being a continuous process in which petroleum production is not interrupted periodically as it is in the cyclical push-pull process. Moreover, the heating effect of steam is combined with the displacement phenomena similar to that employed in water flooding, which causes the creation of an oil bank between the wells which moves toward the production well and effectively displaces a substantial portion of the petroleum from the zone through which the steam moves in the formation.

When a well-to-well throughput steam injection process is applied to a thick reservoir, i.e. a subterranean petroleum saturated formation having vertical thickness of 50 feet or more, the vertical conformance of the steam process is relatively low. By vertical conformance, it is meant the portion of the vertical thickness of a formation through which the injected displacement fluid passes. Because steam is generally injected in a two phase form, at least a substantial portion being in the vapor phase, there is a strong tendency for the vapor phase component of steam to migrate to the upper portion of the petroleum reservoir. Horizontal vapor movement thereafter is confined to the upper portion of the formation, with the result that only a small percentage of the total vertical thickness of the formation is contacted by the vapor phase steam. Since the heat content of the vapor phase portion of steam is substantially higher than the liquid phase content it frequently occurs that only a small portion of thermal energy present in the injected fluid is used for decreasing the viscosity of petroleum and for recovering petroleum from the formation. Thus, it can occur in a throughput steam injection process that live, vapor phase steam exits from the production well, and yet a substantial portion of the formation between the wells, specifically the lower portions of the formation, has not been contacted by steam vapor.

In view of the foregoing discussion, it can be appreciated that there is a substantial, unfulfilled need for a method of conducting a well-to-well throughput steam injection oil recovery method in a manner which results in improved vertical conformance.

SUMMARY OF THE INVENTION

I have discovered, and this constitutes my invention, that the vertical conformance of a well-to-well throughput steam injection oil recovery process can be improved substantially by separating the steam into two fractions, one of which is substantially all liquid phase and the other of which is substantially all in the gaseous phase, and injecting the gaseous phase portion at or near the bottom of the petroleum saturated formation while the liquid portion of the steam is injected at or near the top of the petroleum formation. While both fractions are moving in a horizontal direction away from the injection well and toward the production well, the gaseous phase portion is also moving upward in the formation while the liquid portion is moving downward into the formation. This results in the injected steam mixing and contacting the formation more efficiently, while moving the point where steam vapor contacts exclusively the upper portion of the formation, farther away from the point of injection. The separation process can be accomplished on the surface, with separate injection strings being run from the surface to the two points in the formation where injection is to take place. A convenient method involves injecting the gaseous phase fraction into a centered tubing string while injecting the hot water liquid fraction down the annular space between the tubing string and the well casing. This has the advantage of minimizing the effects of heat losses from the injection well into the formation. Alternatively, the two phase steam fluid may be injected to a point near the formation and then subjected to phase separation downhole by means of a steam separator located in the injection well casing, with the liquid portion then being injected into the upper portion of the formation and the gaseous phase component being injected into the lower portions of the formation.

DESCRIPTION OF THE PREFERRED EMBODIMENT

Figure 1:
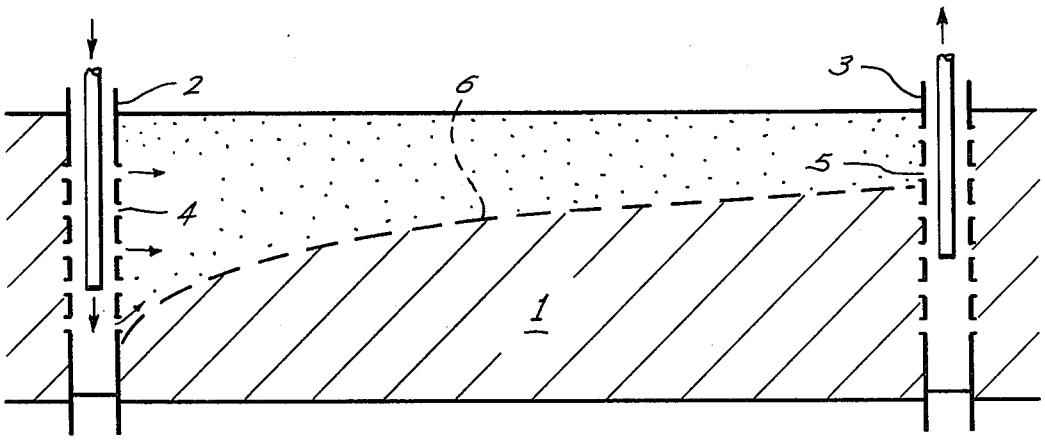
Fig. 1 (PRIOR ART)
FIG. 1 illustrates in cross sectional view, an oil recovery method being subjected to steam flooding by conventional means, wherein the gas phase and liquid phase components are injected simultaneously into the same points in the formation, with resultant channeling of steam vapor into the upper portion of the formation, which causes poor vertical conformance to be experienced in the oil recovery method.

Briefly, the oil recovery process of my invention involves a throughput, well-to-well steam flooding method in which saturated steam is generated on the surface, separated into one component which is essentially all liquid phase and another component which is substantially all gaseous phase, and the liquid phase portion is injected at or near the top of the oil formation with the gaseous phase component being injected at or near the bottom of the oil formation. Separation can be accomplished on the surface with separate injection means from the surface to the injection points, or a downhole separator may be located in the injection well near the injection point.

The process described briefly above may be employed in a viscous petroleum recovery method which involves injecting steam only into the formation, or it may be incorporated with other known techniques described in the art involving the injection of steam and other components into the formation. For example, a minor amount of an alkalinity agent such as sodium or potassium hydroxide included with the liquid portion of the steam is sometimes effective for increasing the oil recovery efficiency in viscous petroleum formations. The presence of the alkalinity agent is believed to stimulate oil recovery by inducing the formation of a low viscosity oil-in-water emulsion, which moves more readily through the subterranean porous formation than does the viscous petroleum itself. Another variation of the steam recovery method involves the injection of a substance which is immiscible with steam and miscible with the formation petroleum, i.e. an effective solvent, simultaneously with injection of steam. The solvent is preferably liquid in the phase at reservoir conditions, and will ordinarily be liquid phase at the temperature and pressure at which steam is injected into the formation. Thus the solvent material would ordinarily be injected with the liquid phase fraction of steam, into the upper portion of the formation.

In applying steam flooding to subterranean formations having relatively low permeability and/or very high viscosity petroleum, an example of which is the tar sand deposits such as are found in the western United States and northwestern Canada, it is sometimes beneficial to incorporate an inert substance into the steam, which substance remains substantially all in the gaseous phase in the formation, thereby precluding the loss of steam or other fluid transmissibility due to cooling of the injected steam and condensation thereof, in the tight formation flow channels. Nitrogen, low molecular weight normally gaseous hydrocarbons such as methane and ethane, as well as carbon dioxide are effective for this purpose. These substances will generally be gaseous at the conditions of steam injection, and so will move with the vapor phase portion of steam and be injected at or near the bottom of the oil reservoir.

In one other embodiment of steam flooding which may be successfully incorporated with the process of my invention, a mixture of air and steam is injected into a subterranean, viscous petroleum-containing formation, which mixture of steam and air initiates a low temperature controlled oxidation reaction within the formation, which is in some instances more effective in displacing the very viscous petroleum such as the asphaltic or bituminous petroleum found in tar sand deposits than is either the more conventional high temperature combustion or steam flooding alone. Since the reaction occurs only in the portion of the formation contacted by the vapor phase components, this is another instance where application of my process will improve the vertical conformance of the oil recovery method. Air and the vapor phase components of steam are injected into the lower portion of the formation while the liquid fraction of steam is simultaneously injected into the upper portion of the formation.

With these preliminary remarks in mind, the process is better understood by referring now to the drawings, in which FIG. 1 illustrates a subterranean, permeable, porous oil formation containing viscous petroleum being subjected to conventional steam flooding. Formation 1 is penetrated by injection well 2 and production well 3, each well being in fluid communication with the central portion of the formation by means of perforations 4 and 5. Steam is injected into well 2 and passes out into formation 1 by means of perforations 4. In this instance, the steam being injected into the formation is saturated, which simply means that there is present both a liquid phase and a gaseous phase simultaneously at the point of injection. Ordinarily saturated steam is defined in terms of quality by specifying the weight fraction which is in the vapor phase. Thus, 80 percent quality steam means that 80 percent of the steam on the basis of weight is vapor with the remaining 20 percent being liquid phase. Oil recovery operations usually involve saturated steam injection because of the high cost expense of generating superheated or all vapor phase steam. In addition, there are always substantial temperature losses throughout the full length of the injection well bore between the surface of the earth and the point of injection, so even if superheated steam is injected into the injection well at the surface, the steam entering the formation will likely be saturated steam because of the heat lost throughout the full length of the injection well.

As the two phase steam enters the portion of formation 1 immediately adjacent to perforations 4 in well bore 2 of FIG. 1, the vapor phase fraction of the steam begins migrating in an upward direction toward the top of the reservoir because of the difference in specific gravity between steam vapor and formation fluids. This occurs simultaneously with a horizontal motion caused by the pressure differential between injection well 2 and production well 3, with the result that vapors move horizontally and upwardly at the same time. This causes the characteristic slanting interface 6 between the steam swept zone and the unswept portion of the formation. It is not uncommon for steam to be channeling only through the upper 30 percent or less of the formation by the time the fluid reaches well bore 3. Once steam has broken through at well 3, continued injection of steam accomplishes little additional oil recovery, since the steam swept portion of the formation 1 above dotted line 6 in FIG. 1, will offer substantially less resistance to the flow than will that portion of the formation below dotted line 6 because of the difference in oil saturation. While there is some vertical movement of heat downward due to conduction, it is very small compared to convective movement upward. Steam injection can, therefore, be continued well past the point where steam vapor is flowing into production well 3, but little or no additional oil will be recovered and a substantial portion of formation 1 will not have been affected by injection of steam into the formation.

Figure 2:
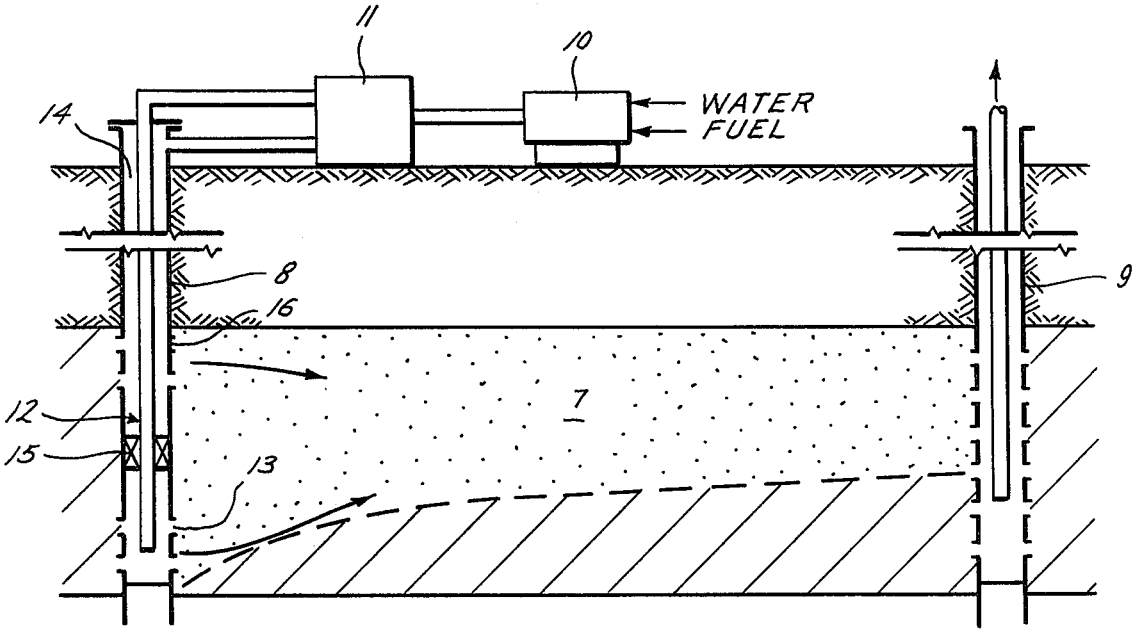
FIG. 2 illustrates a similar oil formation being subjected to the improved steam flooding technique in the present invention, with surface facilities for separating steam into liquid and gaseous phase components, the gaseous phase portion being injected into the lower portion of the formation and the liquid phase portion being injected into the upper portion of the formation with resultant improved vertical conformance.

These and other problems associated with steam injection can be circumvented if the process is conducted in accordance with my invention as is shown in FIG. 2, in which formation 7 is penetrated by injection well 8 and production well 9. On the surface, a steam generator 10 is positioned near injection well 8 and operated so as to produce 85 percent quality steam. The output of generator 10 is sent directly to a steam separator 11, which separates the saturated steam into two separate phases, one being substantially all liquid and one being substantially all gaseous in phase. Ordinarily the gaseous phase will be essentially pure vapor phase water unless the oil recovery method being employed involves injection of other normally gaseous substances simultaneously with steam injection. The liquid component will very likely have appreciable amounts of salts dissolved therein as a consequence of the concentration effect which occurs when feed water having a nominal concentration of salts dissolved therein is passed through a steam generator, since all of the salts remain in the portion of the feed water which is not vaporized and thus they are concentrated in a ratio about equal to the ratio of the liquid component produced to the vapor phase component. In this instance, the presence of salts dissolved in the injection water is not objectionable so long as they do not cause injectivity problems adjacent the production well. Particulate matter should be removed from the feed water by filtering or other means before the water enters steam generator 10 in order to alleviate any formation plugging problems associated therewith.

The vapor phase portions of steam separated in separator 11 passes into tubing 12, which is terminated near the bottom of injection well 8. Perforations 13 in the bottom portion of well 8 permit the vapor phase steam to exit from the well and enter the formation. These perforations should be near the bottom portion of the formation, and will ordinarily be from about 5 to about 25 percent of the total vertical thickness of the formation.

The liquid portion of the separated steam passes through annular space 14 between tubing 12 and well casing 8. Packer 15 isolates the annular space, the packer being about midway between upper perforations 16 and lower perforations 13. The packer insures that substantially all of the liquid phase components separated from the steam which pass down annular space 14, exit through perforations 16 into the upper portion of oil formation 7.

The casing adequately cemented in place in well 9 should be perforated throughout a substantial portion of the viscous petroleum saturated interval, with production of petroleum and other fluids occurring by means of well 9.

It should be pointed out that while the two flow paths necessary in FIG. 8 to inject the liquid phase and gaseous phase components of steam into the formation in the desired points of entry are shown in FIG. 2 as employing a concentric tubing 12 with the annular space 14 between the well casing and the well tubing being utilized for liquid injection, which is the preferred method, parallel tubing strings or other arrangements may be employed, or the roles can be reversed, with liquid passing through the tubing and gaseous phase materials passing through the annular space. The arrangement shown is desirable, however, because it minimizes the effects of heat loss from the injection well to the portion of the overburden above the oil formation. Since phase change will occur and appreciable heat is lost from the gaseous phase materials, it is desirable to minimize the heat losses from the line carrying the gaseous phase component through well 8, such as by placing the gaseous phase in the inner concentric conductor.

If the injection is to be accomplished in a particularly deep formation, it may be desirable to increase the temperature of the gaseous phase materials after separation, so the material entering the formation will be substantially all in the gaseous phase at the point of entry at the bottom of the formation. This can be accomplished by an afterheater located between separator 11 and the well head of well 8, or a downhole heater may be utilized in some instances.

If the oil recovery method is to involve the injection of another material which is gaseous at injection conditions simultaneously or intermittently with steam vapor injection, the material can be mixed with the vapor phase component of steam in tubing 12 by means of suitable connections on the surface. Similarly, if a material which will be liquid at injection conditions, such as a solvent, is to be injected simultaneously and/or intermittently with steam, a connection with the line connecting steam separator 11 with the annular space of well 8 can provide for easily controlled addition of the additional substance.

Figure 3:
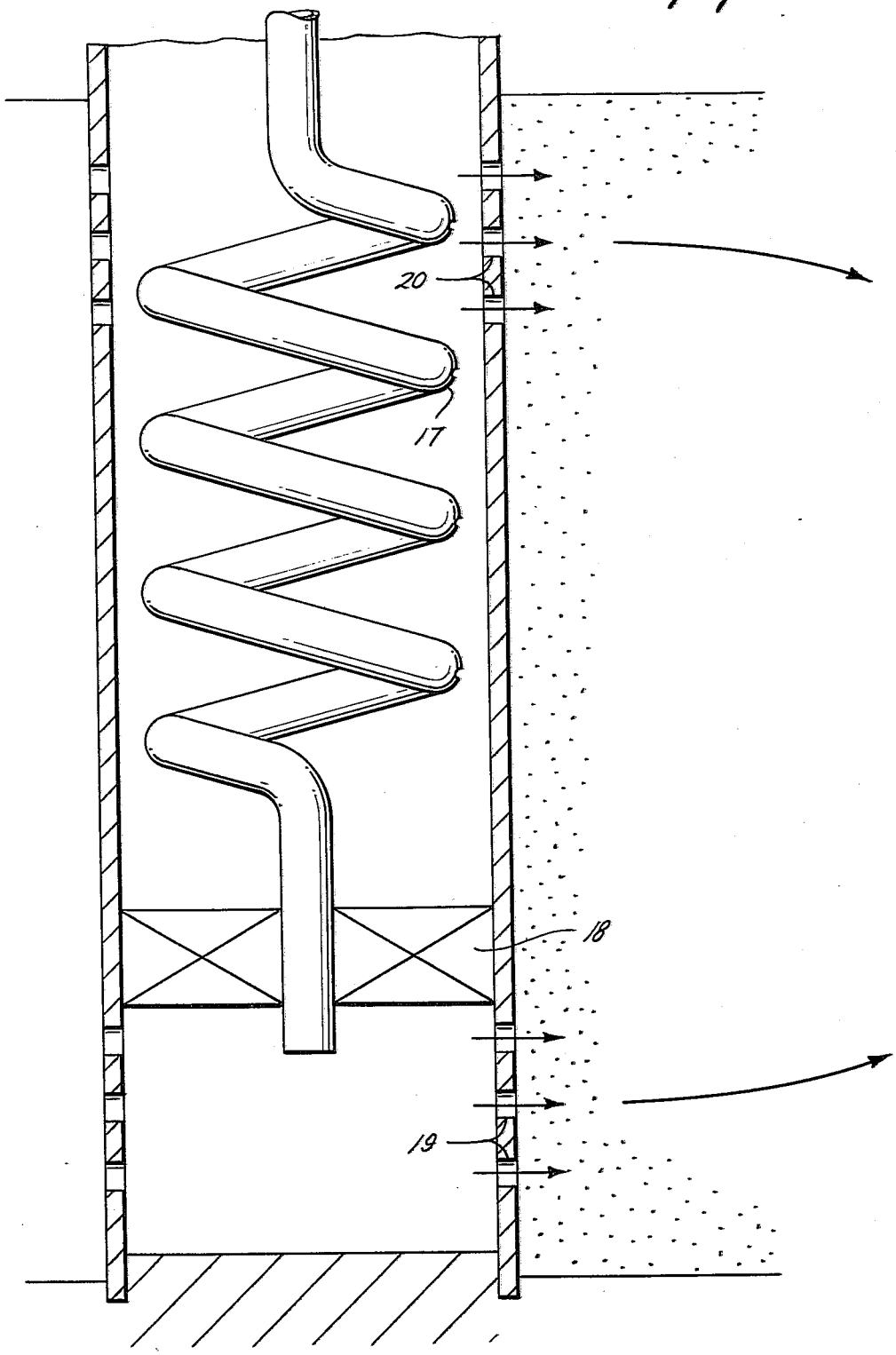
FIG. 3 illustrates a means for separating two phase steam into the desired two separate phases downhole by means of a downhole steam separator, with gaseous phase steam being injected into the lower portion of the formation and liquid phase steam being injected into the top of the formation.

In a slightly different embodiment, the saturated steam is not separated into liquid and gaseous components on the surface, but rather passes into the well bore through a single tubing string. A separator such as that shown in FIG. 3 is connected to the end of the tubing string, which permits a separation of saturated steam into separate gas and liquid phases. One means for accomplishing this involves a helix or helical shaped portion of the tubing with orifices located along the outer periphery of the helix. As the two phase fluid moves through the helical portion of the flow path, centrifical force will cause the liquid fraction to be located on the outside of the helix with the gaseous phase being confined to the inner portion. The small orificies permit the liquid portion to exit from the helix without any portion of the gaseous phase material passing therethrough. The bottom end of the helix then passes through a packer 18 which separates the annular phase below which is in fluid communication with perforations 19 at or near the bottom of the well formation from the perforations in the upper portion of the casing 20 at or near the top of the formation.

FIELD EXAMPLE

For the purpose of additional disclosure of a preferred method of employing the process of my invention to a particular set of field conditions, but without intending that it be in any way limitative or restrictive of my invention, the following pilot field example is furnished.

A subterranean, viscous petroleum reservoir is situated at a depth of 1800 feet. The average thickness of the petroleum reservoir is 90 feet. The petroleum contained in the reservoir has an API gravity of about 11° API, which is so high that little primary recovery can be achieved in this reservoir.

Two wells are drilled 250 feet apart to a depth about 5 feet below the bottom of the oil formation, and casing is set to the full formation depth and cemented at the bottom. A tubing string is run to about the midpoint of each casing. The production well is perforated from a point about 10 feet above the bottom of the formation to a point about 10 feet below the top of the formation. A $20 \times 10^6$ BTU/hr steam generator is located on the surface of the earth, with the output being fed to a steam separator capable of separating 85 percent quality steam into two streams, one of which is substantially all liquid phase and one of which is substantially all gaseous phase. The liquid phase output of the separator is connected to the annular space of the injection well between the production tubing and the casing, and the vapor phase output of the separator is connected to the tubing string. The injection well is perforated from a point about 5 feet above to a point about 15 feet above the bottom of the oil formation, and another set of perforations are formed from a point 15 feet below to a point 5 feet below the top of the formation. A packer is set isolating the annular space between the tubing string and the casing wall at a point just above the end of the tubing. As completed, the vapor phase portion of the generated steam is injected into the tubing which permits introduction of steam into the lower portion of the formation with the liquid phase portion being injected via the annular space into the formation through the perforations at the top of the formation.

Eighty-five percent quality steam is generated by the steam generator, which is fired by natural gas or other available fuel. To avoid initial fracturing or channeling, quantity is maintained initially at an injection pressure below fracturing pressure, usually at a rate below the steam generator capacity, gradually increased over a 10 day period until the final capacity of the generator, $20 \times 10^6$ BTU per hour and water equivalent of approximately 1500 barrels per day is reached, and the steam injection rate is held at or near the capacity of the generator thereafter. Steam vapor is injected exclusively into the bottom of the formation and hot liquid into the top. Steam injection is continued until production is obtained at the production well, and steam injection continued thereafter with oil production being maintained fairly constant, at about 150 to 250 barrels of oil per day with the water-oil ratio being about 6 to 10.

After the water-oil ratio has risen to about 100, it is determined that steam flood has recovered all of the oil that is economically feasible to recover by this method. Based on the projected aerial sweep in this pilot two well pattern, it is calculated that about 80 percent of the oil originally present in the full thickness of the area swept by the injected fluid has been recovered, which indicates the average vertical conformance could exceed 85 percent. This is considered quite satisfactory and substantially greater than would be expected if both liquid and vapor phase components of steam were injected into the formation in a conventional manner as a two phase fluid.

Thus, I have disclosed that it is possible to increase the vertical conformance of a well-to-well, steam injection throughput process by separating the steam into liquid and gaseous components and injecting the gaseous fraction into the bottom of the formation and the liquid portion into the top of the formation. The tendency for steam to channel quickly into the upper portion of the formation, bypassing a substantial portion of the oil near the bottom of the formation is thus greatly reduced, and the vertical conformance of the process is greatly improved.

While my invention has been described in terms of a number of illustrative embodiments, it is not so limited since many variations thereof will be apparent to persons skilled in the art of oil recovery, and particularly thermal oil recovery methods, without departing from the true spirit and scope of my invention. Similarly, while mechanisms have been proposed for purposes of explaining the improved benefits resulting from application of the process of my invention, this has been offered only for additional disclosure and it is not my intention to be restricted to any particular explanation of the mechanism or theory of operation of my invention. It is my desire and intention that my invention be limited and restricted only by those limitations and restrictions as appear in the claims appended hereinafter below.

I claim:

1. In a method of recovering viscous petroleum from a subterranean, permeable, porous, viscous petroleum-containing formation, said formation being penetrated by at least two spaced apart wells in fluid communication with the formation, of the type wherein saturated steam comprising a liquid phase and a gaseous phase is injected into at least one well, said steam passing through the formation, displacing petroleum and reducing the petroleum viscosity, wherein the improvement comprises:

(a) separating the steam into two fractions, one of which is substantially all vapor phase and the other of which is substantially all in the liquid phase;

(b) injecting the vapor phase fraction of the steam at or near the bottom of the petroleum formation; and (c) injecting the liquid fraction at or near the top of the petroleum formation.

2. A method as recited in claim 1 wherein the vapor phase fraction is injected into the bottom 20 percent of the vertical thickness of the formation.

3. A method as recited in claim 2 wherein the vapor phase fraction is injected into the bottom 10 percent of the vertical thickness of the formation.

4. A method as recited in claim 1 wherein the liquid phase fraction is injected into the upper 20 percent of the full vertical thickness of the petroleum formation.

5. A method as recited in claim 4 wherein the liquid phase fraction is injected into the top 10 percent of the vertical thickness of the petroleum formation.

6. A method as recited in claim 1 wherein steam is separated into hot liquid phase and vapor phase components on the surface of the earth, and the injection well is provided with two separated flow paths from the surface, the first flow path being in fluid communication with the upper 5 to 25 percent of the formation and the second flow path being in fluid communication with the bottom 5 to 25 percent of the formation and the hot liquid phase is injected via the first flow path and steam vapor phase is injected into the second flow path.

7. A method as recited in claim 1 wherein the saturated steam is injected into the injection well and separated into liquid and vapor phase components at a point near the petroleum formation by means of a downhole steam separator.

8. A method as recited in claim 1 wherein a substance which is gaseous at formation conditions is comingled with vapor phase steam fraction and injected into the lower portion of the formation.

9. A method as recited in claim 8 wherein the substance which is gaseous at formation conditions is selected from the group consisting of air, nitrogen, low molecular weight hydrocarbons having from 1 to 4 carbon atoms, carbon dioxide and mixtures thereof.

10. A method as recited in claim 1 wherein a substance is co-mingled with the hot liquid phase fraction and injected into the upper portions of the formation simultaneously therewith.

11. A method as recited in claim 10 wherein the substance co-mingled with the liquid phase fraction is selected from the group consisting of sodium hydroxide, potassium hydroxide, and high molecular weight hydrocarbons having at least 6 carbon atoms, and mixtures thereof.

12. A method of recovering viscous petroleum from a subterranean, viscous petroleum-containing, permeable formation, said formation being penetrated by at least two wells in fluid communication therewith, comprising (a) injecting substantially 100 percent vapor phase steam into the lower 5 to 25 percent of the petroleum formation;

(b) injecting hot water into the upper 5 to 25 percent of the petroleum formation simultaneously with the injection of vapor phase steam; and (c) recovering petroleum mobilized by the vapor phase steam and hot water from a remotely located well.

* * * * *